US005079811A

United States Patent [19]

Tachibana et al.

[11] Patent Number: 5,079,811

[45] Date of Patent: Jan. 14, 1992

[54] METHOD AND APPARATUS FOR FEEDING THREAD PNEUMATICALLY IN DRAWING-IN

[75] Inventors: Juro Tachibana, Matsuyama; Yoshihide Nishimura, Ehime, both of Japan

[73] Assignee: Teijin Seiki Company Limited, Osaka, Japan

[21] Appl. No.: 500,556

[22] Filed: Mar. 28, 1990

[30] Foreign Application Priority Data

Apr. 4, 1989 [JP] Japan ..... 1-86619

[51] Int. Cl.[5] ..... D03J 1/14

[52] U.S. Cl. ..... 28/204

[58] Field of Search ..... 28/202–208

[56] References Cited

U.S. PATENT DOCUMENTS 4,723,346 2/1988 Tachibana et al. ..... 28/206
4,894,893 1/1990 Okuda ..... 28/204
4,916,784 4/1990 Tachibana et al. ..... 28/203

FOREIGN PATENT DOCUMENTS 3295744 12/1988 Japan ..... 28/204
1020360 1/1989 Japan ..... 28/205
89-01066 2/1989 Japan ..... 28/205
1260042 10/1989 Japan ..... 28/204
1260043 10/1989 Japan ..... 28/204

*Primary Examiner*—W. C. Reynolds
*Assistant Examiner*—John J. Calvert
*Attorney, Agent, or Firm*—Lane, Aitken & McCann

[57] ABSTRACT

A feed method of feeding a thread wound on a bobbin to a thread drawing-in apparatus through first and second suction nozzles, comprising the steps of: advancing the thread to a first position between the bobbin and the first suction nozzle, along an axis; gripping the advanced thread at the first position and then drawing the thread at the first position in a predetermined direction substantially perpendicular to the axis of a first predetermined length; gripping the drawn thread at a second position between the bobbin and the first position and also releasing the drawn thread at the first position, and then feeding the drawn thread to the thread drawing-in apparatus; gripping the fede thread at a third position between the second suction nozzle and the thread drawing-in apparatus and also releasing the thread at the first and second positions, and then drawing the thread at the third position in the predetermined direction by a second predetermined length; and cutting the thread that has been drawn by the second predetermined length.

5 Claims, 9 Drawing Sheets

METHOD AND APPARATUS FOR FEEDING THREAD PNEUMATICALLY IN DRAWING-IN

FIELD OF THE INVENTION

The present invention relates to a method and apparatus for feeding a thread which feed the thread to a thread drawing-in apparatus and cut into a predetermined length the thread that has been passed through drops and a heddle in the thread drawing-in apparatus. The thread cut into the predetermined length will become the guiding portion of a warp thread.

BACKGROUND OF THE INVENTION

Before weaving can commence, a variety of preparatory operations have to be carried out. For example, as a drawing-in operation, a large number of warp threads wound on the warp beam are required to be passed one by one through the eyes of a heddle and drops. For this drawing-in operation, various kinds of automated drawing-in apparatuses have been employed. Further, a variety of methods and apparatuses have been developed to automatically feed the warp threads one by one to the drawing-in apparatus. For example, as such apparatuses, the applicant of the present invention has proposed in Japanese patent application No. 62-153001 (which has not been published yet) a thread feed apparatus as shown in FIGS. 8–11. In FIG. 8, reference numeral 1 designates a warp beam on which a large number of threads 2 are wound, the warp beam 1 being supported horizontally to a horizontal frame 4 of a drawing frame 3. The threads 2 on the warp beam 1 are unwound from the beam 1 and then drawn tautly by upper and lower drawing channel beams 6 and 7 mounted horizontally on an upright stand 5 of the drawing frame 3, in order to provide a large number of parallel threads 2 each having a length required to the thread drawing-in operation, as shown in FIG. 9. Since the parallel threads 2 are drawn tautly by hand, gripping plates 8 and 9 are inserted into the grooves formed in the drawing channel beams 6 and 7 in order to facilitate the drawing of the parallel threads 2. After the parallel threads 2 have been gripped by the gripping plates 8 and 9, they are drawn tautly by moving the drawing beams 6 and 7 away from each other by suitable means (not shown). In FIG. 9, reference numerals 10 and 11 denote a pair of leasing threads each passing in and out between the leading ends of the parallel threads 2. The leasing threads 10 and 11 are provided to easily separate the parallel threads 2 from one another.

FIGS. 10 and 11 schematically illustrate a thread feed apparatus 13 which feeds to a thread drawing-in apparatus 12 the parallel threads 2 drawn tautly to the drawing frame 3 as described above. The drawing frame 3 shown in FIG. 8 is moved laterally with the aid of the wheels 14 of the horizontal frame 4, together with the warp beam 1, and connected to the front face of a frame 15 of the thread drawing-in apparatus 12 shown in FIG. 10. The thread feed apparatus 13 extends between the drawing beams 6 and 7 of the connected drawing frame 3 along the frame 15. The thread feed apparatus 13 comprises a cutter 16, a leasing tube 17 for the leasing threads 10 and 11, a hook 18 for separation, a warp chuck 19, a suction block 20, a warp lowering hook 21, a warp holding hook 22, and a warp holding bar 23. Reference numerals 24 and 25 indicate a suction nozzle and guide nozzle of the thread drawing-in apparatus 12, respectively. The thread 2 fed by the thread feed apparatus 13 is drawn in with the aid of the injection effect of compressed air and passed through the eye of a drop 26 positioned between the suction nozzle 24 and the guide nozzle 25. While only a pair of the suction and guide nozzles 24 and 25 are shown, a large number of pairs of the suction and guide nozzles are provided so that the thread can be passed through the eyes of the heddles and drops at the same time. These nozzles constitute the major parts of the thread drawing-in apparatus 12.

In FIG. 11, among a large number of the parallel threads 2 drawn tautly to the thread feed apparatus 13, the thread end of the most right thread 2 in FIG. 11 is released from the leasing threads 10 and 11 by the leasing tube 17, and gripped and moved rightward by the separation hook 18. The thread end of the thread 2 is gripped by the advancing warp chuck 19, as shown by the imaginary line in FIG. 10, and is then cut in the vicinity of the drawing beam 6 by means of the cutter 16. At the same time, the upper half portion of the cut thread 2 is drawn into the suction block 20 through a vertically extending groove 20*a* formed in the front face of the suction block 20 by means of a vacuum pressure, as shown by the imaginary line. The warp holding hook 22 is then moved toward the suction block 20 so that a bridge portion 2*a* is formed between the holding hook 22 and the war holding bar 23. Thereafter, the warp lowering hook 21 is lowered together with a belt 28 which is driven by rotation of a drive pulley 32. As the hook 21 is lowered, the bridge portion 2*a* of the thread 2 is lowered to the drawing beam 7, and the thread end of the thread 2 is guided by the suction block 20 and lowered to a position adjacent to the suction nozzle 24, as shown by the broken line in FIG. 10. At the same time, as shown by the imaginary line in FIG. 11, the warp holding bar 23 is rotated downward to release the lower portion of the thread 2 in the side of the drawing beam 7. Consequently, the thread 2 is drawn through the eye of the drop 26 by the suction nozzle 24. The gripping force with which the warp chuck 19 grips the thread 2 has been set so that the thread 2 can be easily released from the chuck 19 by the down movement of the warp lowering hook 21. In FIGS. 10 and 11, reference numerals 29, 30 and 31 indicate nozzles which are connected to a vacuum source to introduce a vacuum pressure into the suction block 20. Reference numeral 27 indicates a driven pulley over which the belt 28 driven by the drive pulley 32 passes. Reference numeral 33 indicates a nozzle which supplies compressed air to the suction nozzle 24. Besides the thread feed apparatus 13 constructed as described above, there is also known another thread feed apparatus of the type in which a taut thread is gripped at its thread end by one end of an arm member and guided to the suction nozzle 24 of the thread drawing-in apparatus 12 by rotation of the arm member about the other end thereof. In either case, a large number of threads that have been drawn tautly to the drawing frame 3 or similar frame are fed one by one to the thread drawing-in apparatus 12.

However, the above described thread feed apparatus (which has not been published yet) or conventional thread feed apparatus has the following drawbacks (i)–(v), since after a large number of parallel threads have been drawn tautly to the drawing frame or similar frame, they are separated one by one and fed one by one to the thread drawing-in apparatus.

(i) An apparatus incident to the thread drawing-in apparatus increases the cost of apparatus, since there is the need for a drawing frame to draw threads tautly from a warp beam, or for a feed apparatus of high speed and high accuracy to feed the tautly drawn threads one by one to the thread drawing-in apparatus.

(ii) The working load of workers engaged in the thread drawing-in operation is increased, and the thread drawing-in cost and accordingly the production cost of final products (textile fabrics) becomes large. That is to say, since several thousands of threads are wound on one warp beam and required to be drawn tautly on the drawing frame by the workers, the production cost is increased.

(iii) The space for apparatuses required to the thread drawing-in operation and space for work become large and therefore add to the overall area of the textile factory. Since the space for an apparatus incident to the drawing-in apparatus is large and since the travel space for the drawing frame or working space for drawing threads tautly becomes large, these spaces add to the overall area of the textile factory.

(iv) The thread drawing-in rate is greatly reduced, depending upon the nature and characteristics of the thread. A variety of threads, for example, nappy threads, stiff threads or very fine threads are used to make textile fabrics. Since the separation of the thread ends of the threads having such nature and characteristics is very difficult, the supply of the threads is not performed smoothly. In addition, the thread tends to be hooked on the apparatus and cut due to the insufficient flexibility and nap of the thread. Since particularly very fine threads tend to be easily cut, the thread drawing-in rate is greatly reduced.

(v) Since the number of threads wound on one beam has a limit and since the beam mounted to the drawing frame is normally limited to one, the thread drawing-in operation of wide textile cloth wherein the number of warp threads is large was difficult.

Accordingly, it is an objective of the present invention to provide an improved method and apparatus for feeding threads which can overcome the above described drawbacks (i)–(v).

SUMMARY OF THE INVENTION

In accordance with one important aspect of the present invention, there is provided a feed method of feeding a thread wound on a bobbin to a thread drawing-in apparatus through first and second suction nozzles, comprising the steps of: (1) advancing the thread from the bobbin to a first position between the bobbin and the first suction nozzle, along an axis; (2) gripping the advanced thread at the first position and then drawing the thread from the bobbin a the first position in a predetermined direction substantially perpendicular to the axis by a first predetermined length; (3) gripping the drawn thread at a second position between the bobbin and the first position and also releasing the drawn thread at the first position, and then passing the drawn thread through the first and second suction nozzles to feed it to the thread drawing-in apparatus; (4) gripping the fed thread at a third position between the second suction nozzle and the thread drawing-in apparatus and also releasing the thread at the first and second positions, and then drawing the thread from the bobbin at the third position in the predetermined direction by a second predetermined length; and (6) cutting the thread that has been drawn by the second predetermined length, in such a manner that a length of the thread from the third position to the cut end of the thread becomes the predetermined second length.

In accordance with another important aspect of the present invention, there is provided a feed apparatus for feeding a thread wound on a bobbin to a thread drawing-in apparatus along an axis, comprising: (1) a first suction nozzle disposed downstream of the bobbin and formed with a passageway through which the thread is passed; (2) a second suction nozzle disposed downstream of the first suction nozzle and formed with a passageway through which the thread is passed; (3) first gripping means disposed between the bobbin and the first suction nozzle and for gripping and releasing the thread drawn from the bobbin; (4) first drawing means provided between the bobbin and the first gripping means and movable in a predetermined direction substantially perpendicular to the axis, the thread being gripped by the first gripping means and then being drawn from the bobbin in the predetermined direction by a first predetermined length by the first drawing means; (5) second gripping means disposed between the bobbin and the first drawing means and for gripping and releasing the thread that has been drawn by the first drawing means; (6) third gripping means disposed between the second suction nozzle and the thread drawing-in apparatus and for gripping and releasing the thread that has been fed through the first and second suction nozzles to the thread drawing-in apparatus; (7) second drawing means provided between the first and second suction nozzles and movable in the predetermined direction, the thread fed to the thread drawing-in apparatus being gripped by the third gripping means and being also released from the first and second gripping means, and then being drawn from the bobbin in the predetermined direction by a second predetermined length by the second drawing means; and (8) cutting means disposed between the first suction nozzle and the second drawing means and for cutting the thread drawn by the second drawing means in such a manner that a length of the thread from the third gripping means to the cut end of the thread becomes the predetermined second length.

In the present invention, the thread is drawn from the bobbin by the first drawing means by the first predetermined length, that is, a length required to the thread drawing-in operation, and fed to the thread drawing-in apparatus. The thread is further drawn from the bobbin by the second drawing means by the second predetermined length, that is, a length required to join the thread with a warp thread on a warp beam, and then cut. Therefore, the guiding portions of the warp threads that have already been passed through the heddle or drops can be formed successively according to the number of the warp threads and joined with the warp threads. As a result, the need for drawing the warp thread tautly on the drawing frame is eliminated and the above described drawbacks (i)–(v) thus overcome.

BRIEF DESCRIPTION OF THE DRAWINGS

The features and advantages of a feed method and apparatus according to the present invention will be more clearly understood from the following description taken in conjunction with the accompanying drawings.

DESCRIPTION OF THE PREFERRED EMBODIMENTS

The present invention will hereinafter be described in reference to the accompanying drawings.

Figure 1:
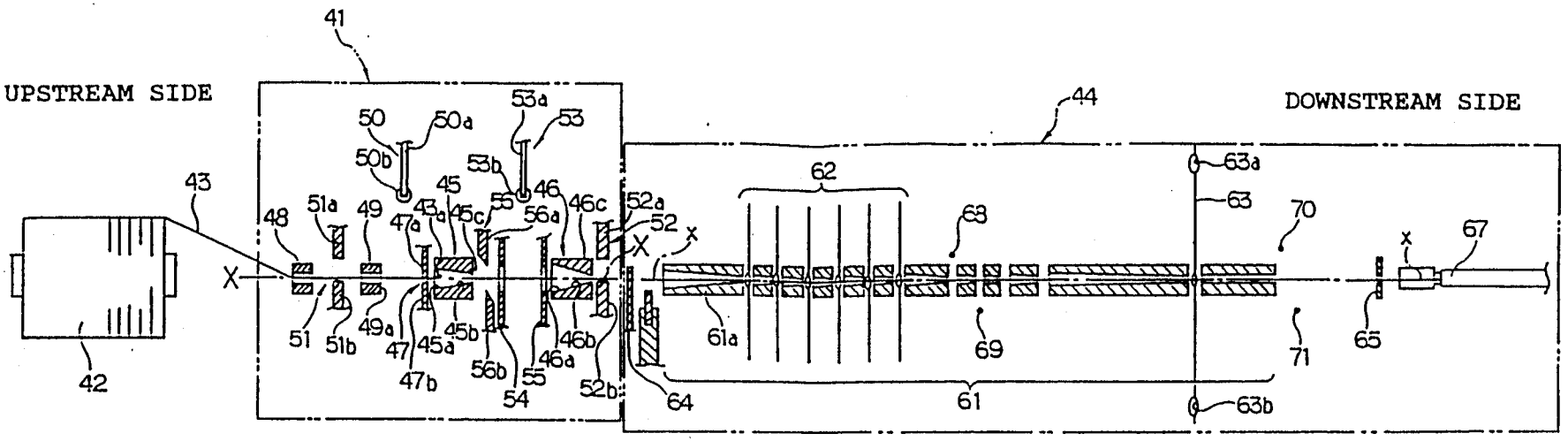
FIG. 1 is a longitudinal sectional view showing one embodiment of a feed apparatus according to the present invention, and a thread drawing-in apparatus to which the thread is fed by the feed apparatus.

FIGS. 1–6 illustrate one embodiment of a thread feed apparatus according to the present invention. In FIG. 1, the thread feed apparatus of this embodiment is generally designated by reference numeral 41. The thread feed apparatus 41 feeds along a horizontal axis X—X a thread 43 wound on a bobbin 42 which is provided at the upstream side (left side in FIG. 1), and supplies the thread 43 to a thread drawing-in apparatus 44 in the downstream side. The thread feed apparatus 41 comprises a first suction nozzle 45 and a second suction nozzle 46 which are disposed on the horizontal axis X—X. The first and second suction nozzles 45 and 46 are connected to a source of compressed air. If the thread 43 is introduced to an inlet port 45*a* of the first suction nozzle 45, then compressed air is suppled to the passageway 45*b*in the form of taper, and the thread 43 is transferred to the downstream side along the axis X—X by the injection effect of the compressed air. Likewise, if the thread 43 from the first suction nozzle 45 is introduced into the inlet port 46*a* of the second suction nozzle 46, then the thread 43 is transferred along the axis X—X and supplied to the thread drawing-in apparatus 44 with the aid of the compressed air supplied to the passageway 46*b*. While the first suction nozzle 45 in the upstream side comprises a closed type nozzle, the second suction nozzle 46 in the downstream side comprises a nozzle of 20 the closing type in which an upper block 46*c* of the nozzle is rotatable about a horizontal pin (not shown) extending along the horizontal axis X—X.

Figure 2:
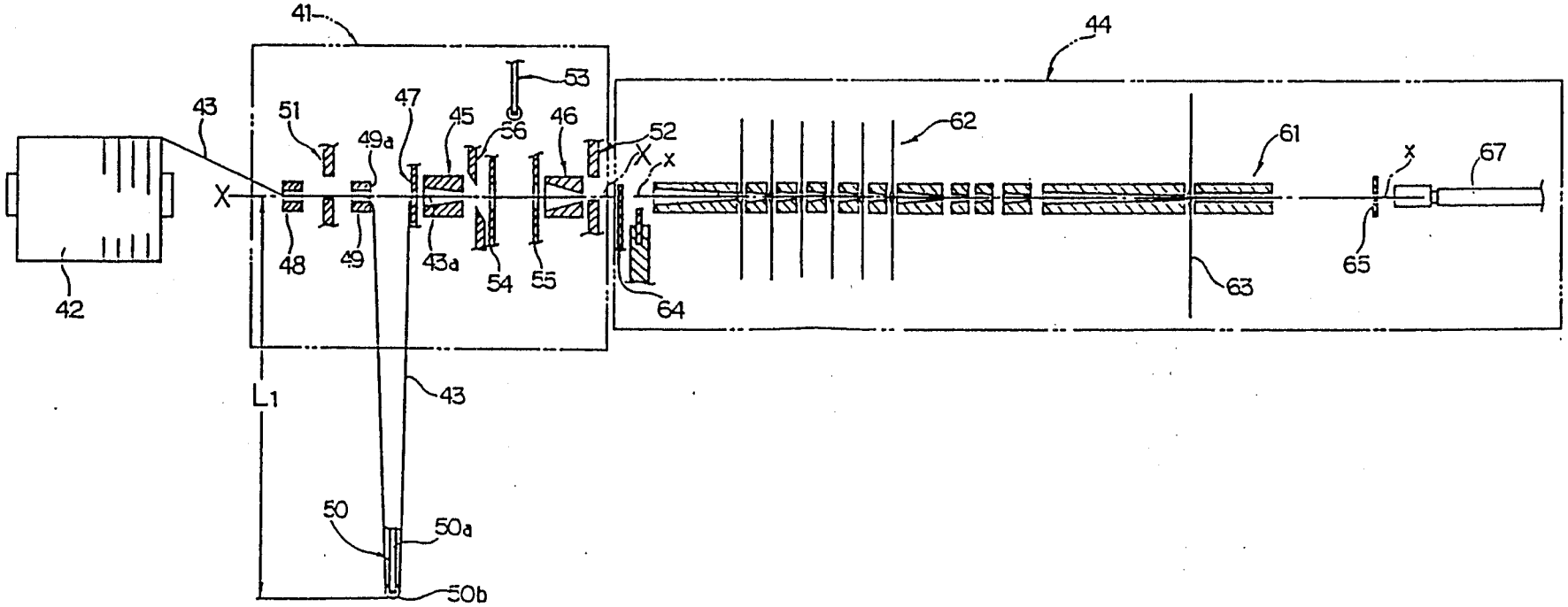
FIG. 2 is a view similar to FIG. 1 showing the first thread chuck in closed position and the second thread chuck in open position wherein the thread is drawn down by the first draw rod.

In FIG. 1, reference numeral 47 indicates a first thread chuck provided in the vicinity and upstream side of the first suction nozzle 45, the first thread chuck 47 including a pair of upper and lower grip members 47*a* and 47*b* which are provided across the horizontal axis X—X. At least one of the grip members 47*a* and 47*b* is driven to move toward each other by suitable drive means (not shown) so that the thread end 43*a* of the thread 43 drawn from the bobbin 42 can be gripped and fixed. The grip members 47*a* and 47*b* is also driven to move away from each other by the drive means (not shown) to release the thread end 43*a* therefrom. Thus, the first thread chuck 47 is movable between an open position wherein the thread 43 is released and a closed position wherein the thread 43 is gripped. The first thread chuck 47 constitutes first gripping means of the present invention, and in FIG. 1, there is shown the first thread chuck 47 in the closed position. Reference numerals 48 and 49 denote thread guides provided on the axis X—X in the upstream side of the first thread chuck 47. The thread 43 drawn from the bobbin 42 is passed through the thread guides 48 and 49 and supported horizontally. Between the thread guide 49 and the first thread chuck 47, there is provided a first draw rod 50 which has a vertical guide rod 50*a* and a guide roller 50*b* freely rotatably supported on the lower end of the guide rod 50*a*. The upper end of the guide rod 50*a* is connected to a source of drive (not shown) so as to be movable in the up-and-down direction substantially perpendicular to the horizontal axis X—X. As shown in FIG. 2, when the leading end 43*a* of the thread 43 is gripped by the first thread chuck 47, the first draw rod 50 is lowered to a position spaced $L_1$ distance from the axis X—X, so that a generally U-shaped dangling portion of the thread 43 is formed between the thread guide 49 and the first thread chuck 47. At this time, the guide roller 50*b* is brought into engagement with the thread 43 by the guide rod 50*a*, and is rotating to guide the thread 43 in the down direction. The overall length of the dangling portion of the thread 43 from the first thread chuck 47 to an end face 49*a* of the thread guide 49 is a first predetermined dimension $l_1$ which corresponds to a sum of the length of the thread feed apparatus 41 in the downstream side of the first thread chuck 47 and the length of the thread 43 that is drawn in by the thread drawing-in apparatus 44. Thus, the first draw rod 50 functions as first drawing means which draws the thread 43 gripped by the first thread chuck 47 from the grip position of the first thread chuck 47 by the length of the first predetermined dimension $l_1$. Therefore, by suitably setting the predetermined distance $L_1$ to which the first draw rod 50 is lowered, the thread drawing-in length can be changed depending upon the types of the thread drawing-in apparatus 44.

Figure 3:
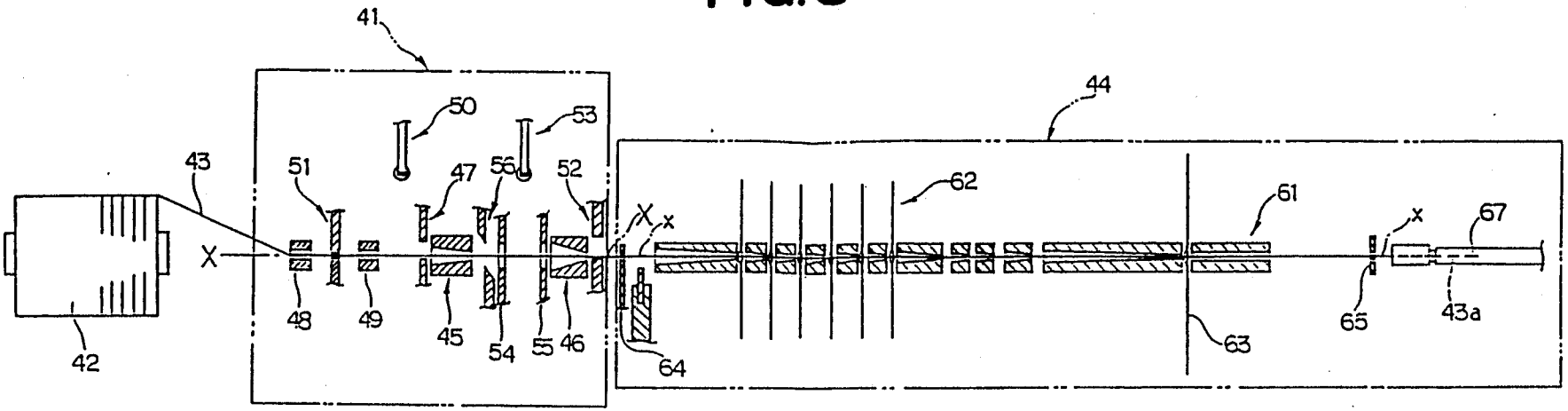
FIG. 3 is a view similar to FIG. 1 showing the second thread chuck in closed position and the first and third thread chucks in open position wherein the thread is fed through the first and second suction nozzle to the thread drawing-in apparatus.
Figure 4:
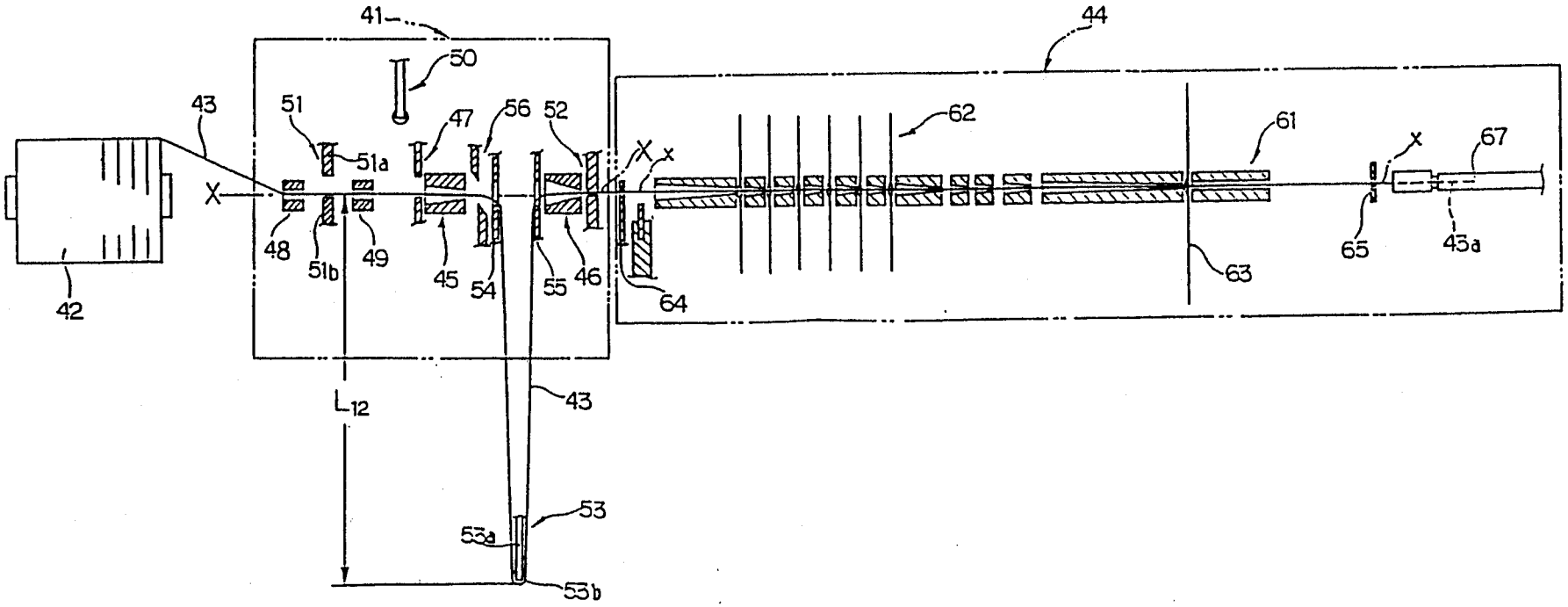
FIG. 4 is a view similar to FIG. 1 showing the third thread chuck in closed position and the first and second thread chucks in open position wherein the thread is drawn down by the second draw rod.

In FIG. 1, a second thread chuck 51 is disposed between the thread guides 48 and 49. The second thread chuck 51 is substantially identical in construction and function with the first thread chuck 47, and likewise comprises a pair of grip members 51*a* and 51*b*. The second thread chuck 51 is driven by a special drive source (not shown) in the same way as the first thread chuck 47, and functions as second gripping means which grips and releases the upstream side of the thread 43 drawn out by the first draw rod 50. Reference numeral 52 indicates a third thread chuck provided between the second suction nozzle 46 and the thread drawing-in apparatus 44, the third thread chuck 52 also having a pair of grip members 52*a* and 52*b* having the same construction and function as the first thread chuck 47. The third thread chuck 52 is driven by a special drive source (not shown) in the same way as the first thread chuck 47, and as shown in FIG. 3, functions as third gripping means that grips the thread 43 whose U-shaped dangling portion shown in FIG. 2 was supplied to the thread drawing-in apparatus 44 through the first and second suction nozzles 45 and 46 after the thread 43 was gripped by the second thread chuck 51 and released from the first thread chuck 47. Further, a second draw rod 53 is provided between the first and second suction nozzles 45 and 46, as shown in FIG. 1. The second draw rod 53 comprises a vertical rod **53*a* and a guide roller 53*b* which have the same construction as those of the first draw rod 50, and the draw rod 53*a* is connected to a special drive source so that it can move in the up-and-down direction substantially perpendicular to the horizontal axis X—X. Thread removing hooks 54 and 55 are provided between the first and second suction nozzles 45 and 46, and the second draw rod 53 is lowered and raised in the up-and-down direction between the hooks 54 and 55. The thread removing hooks 54 and 55 are movable laterally together with the thread drawing-in apparatus 44 in order to remove the downstream side of the thread 43 from the thread feed apparatus 41 after the thread 43 has been passed through the thread drawing-in apparatus 44. As shown in FIG. 4, the second draw rod 53 is lowered by a predetermined distance $L_{12}$ from the axis X—X to draw down the thread 43 that has been gripped by the third thread chuck 52 and released from the first and second thread chucks 47 and 51. Consequently, the thread 43 is drawn from the bobbin 42 so as to have a generally U-shaped dangling portion between the thread removing hooks 54 and 55. At this time, the guide roller 53*b* of the guide rod 53*a* is rotated to guide the thread 43 being drawn out, as in the case of the first draw rod 50. Although in this embodiment it has been described that each of the first and second draw rods 50 and 53 comprises the vertically movable rod and the guide roller, the present invention is not limited to these draw rods. For example, in order to draw out the thread 43 and form the U-shaped dangling portion, there may be provided an arm member with a guide roller similar to the guide roller 50*a* or 53*a* which is rotatable about its one end along a plane substantially perpendicular to the axis X—X. In addition, the up-and-down motion of the first draw rod 50 or second draw rod 53** is not necessarily limited to the exact vertical direction of the axis X—X.

In FIG. 1, a cutter 56 is provided between the first suction nozzle 45 and the thread removing hook 54. The cutter 56 has a pair of blades **56*a* and 56*b* for cutting the thread 43 between the first suction nozzle 45 and the thread removing hook 54. The blades 56*a* and 56*b* is connected to a source of drive (not shown) so that they can be moved toward and away from each other. If, as shown in FIG. 4, the second draw rod 53 is lowered by the predetermined distance $L_{12}$ from the axis X—X, then the length of the thread 43 from the gripping position of the third thread chuck 52 to the cutting position of the cutter 56 along the U-shaped portion of the thread 43 becomes a second predetermined dimension $l_2$ which is to be set to a length that a tieing-in machine 81 (FIG. 7) requires. Thus, the second draw rod 53 functions as second drawing means for drawing out the thread 43 by the second predetermined dimension $l_2$, and the cutter 56 functions as cutting means for cutting the thread 43 drawn out by the second draw rod 53 at the position of the second predetermined dimension $l_2$from the gripping position of the third thread chuck 52. The above described first thread chuck 47, thread guides 48, 49, first draw rod 50, second thread chuck 51, third thread chuck 52, second draw rod 53, thread removing hooks 54, 55, and cutter 56 constitute the essential components of the thread feed apparatus 41 of the present invention, together with the first and second suction nozzles 45 and 46. The thread feed apparatus 41 is disposed on a frame structure (not shown) along the axis X—X and adjacent to the thread drawing-in apparatus 44. The drive sources for driving the first thread chuck 47, first draw rod 50, second thread chuck 51, third thread chuck 52, second draw rod 53 and cutter 56** may be of the compressed air drive type, hydraulic drive type or electric drive type. In addition, in order to accurately control these operations at high speed in accordance with predetermined programs, a control part (not shown) comprising microcomputers and the like is provided.

Figure 6:
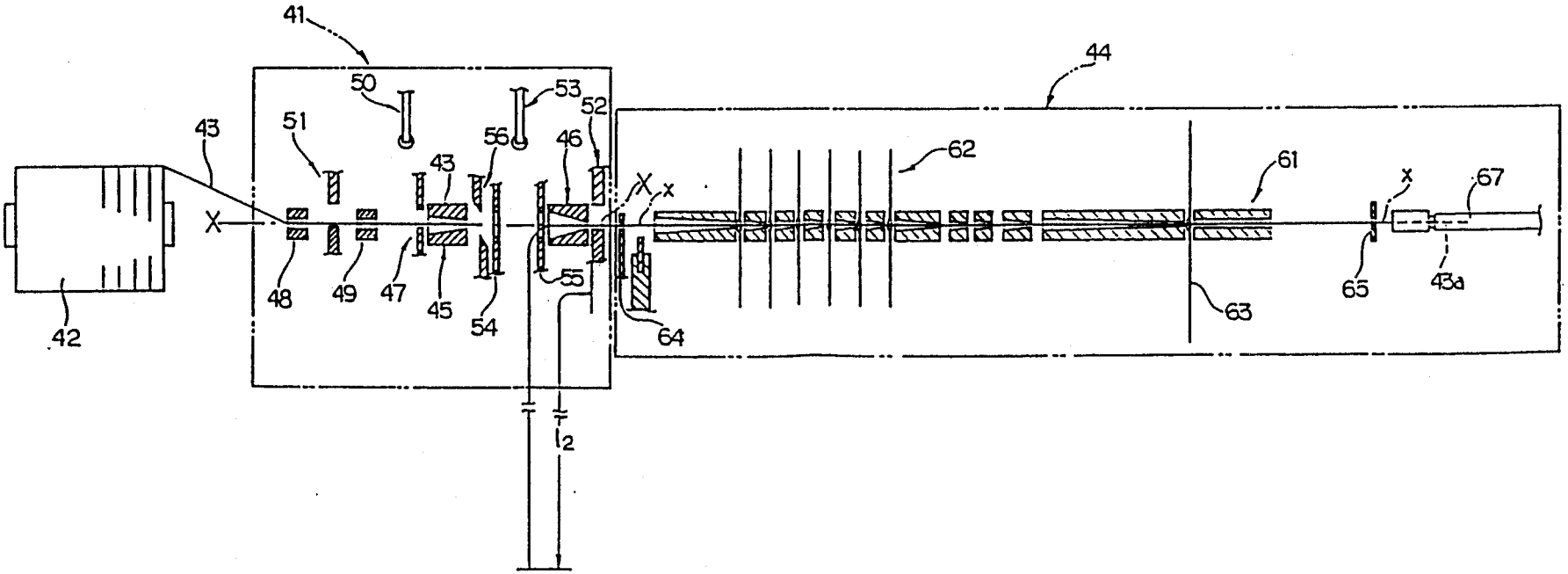
FIG. 6 is a view similar to FIG. 1 showing the cut thread end to be joined with a warp thread.
Figure 7:
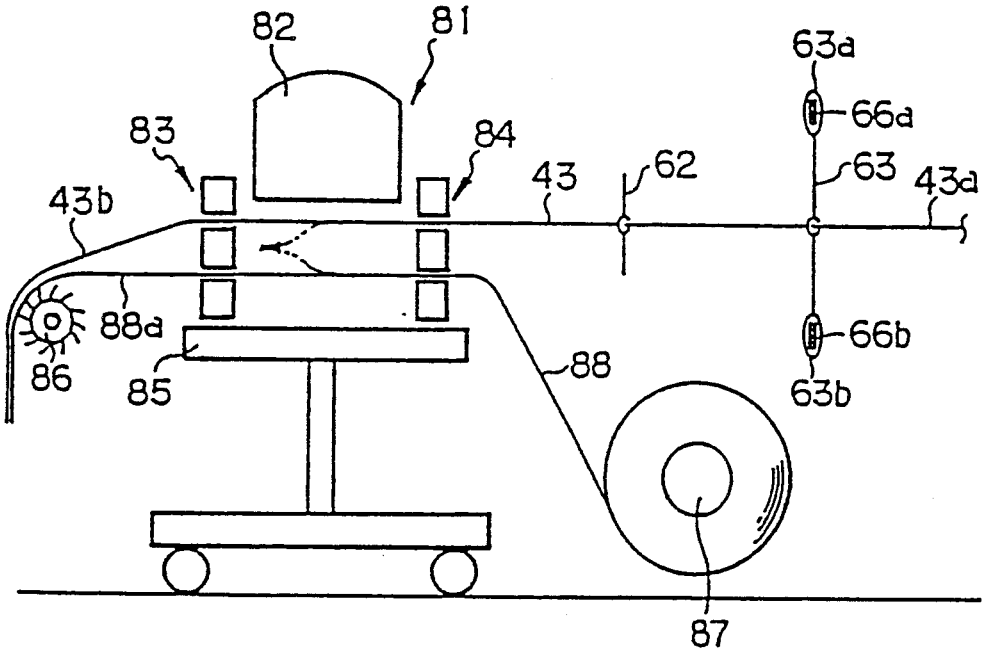
FIG. 7 is a side view showing a tieing-in machine by which the cut thread end is joined with the warp thread.
Figure 8:
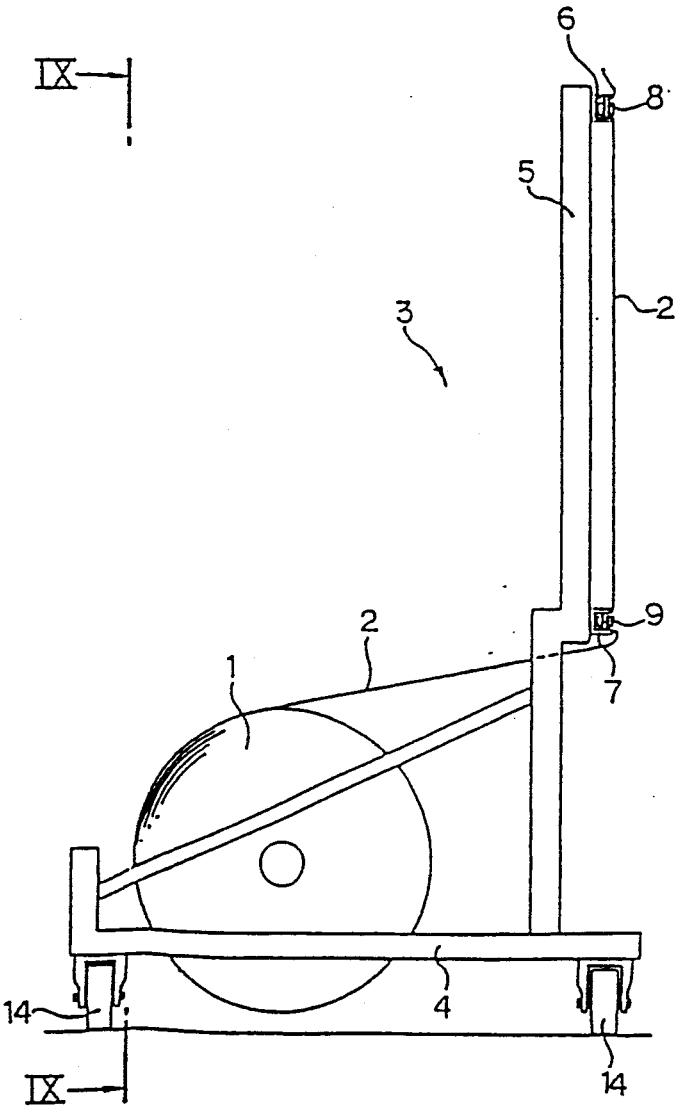
FIG. 8 is a front view showing a drawing frame wherein a large number of parallel warp threads are drawn tautly by hand.
Figure 9:
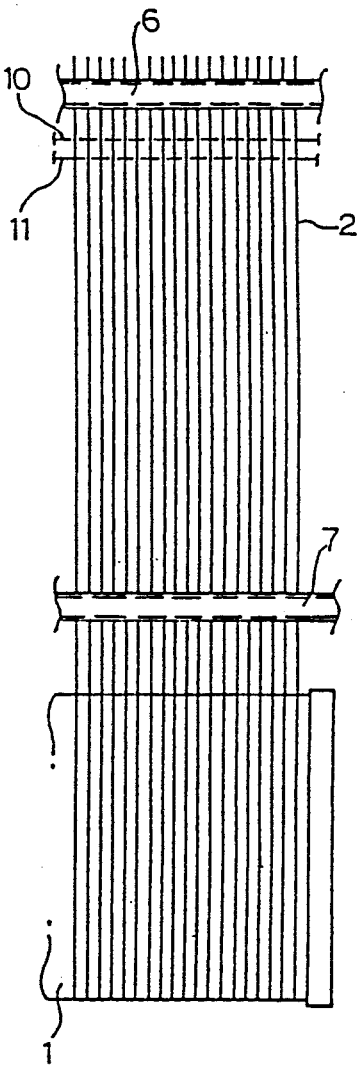
FIG. 9 is a view taken substantially along line IX—IX of FIG. 8.
Figure 10:
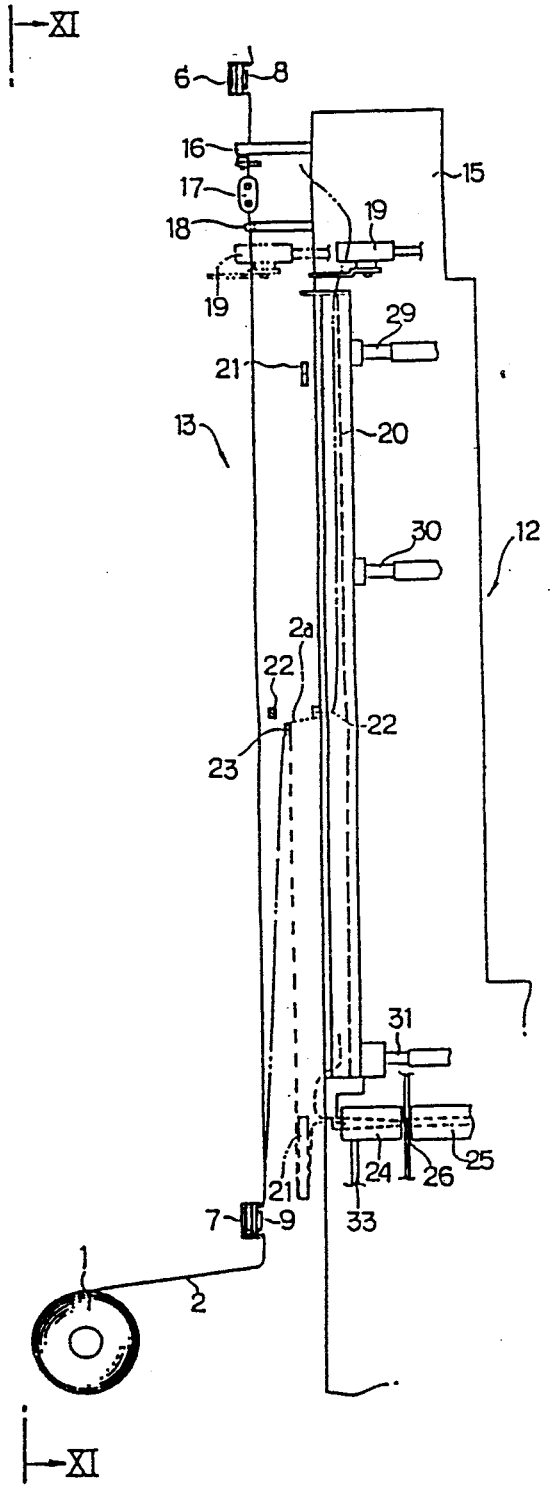
FIG. 10 is a front view showing the structure of a thread feed apparatus to which the warp thread is supplied from the drawing frame of FIG. 8.
Figure 11:
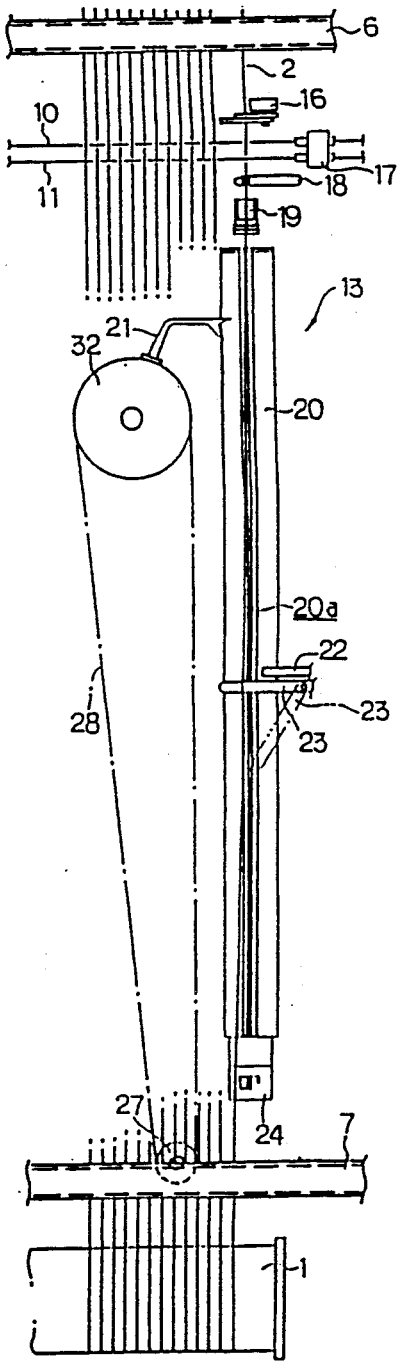
FIG. 11 is a view taken substantially along line XI—XI of FIG. 10.

In FIG. 1, a large number of thread drawing-in nozzles generally designated by reference numeral 61 are the major components of the thread drawing-in apparatus 44, and arranged in sequence on the axis X—X. The thread drawing-in nozzles 61 are nozzles of the closing type and have the same constructions and functions as the second suction nozzle 46 of the thread feed apparatus 41. Between the thread drawing-in nozzles 61 there are positioned a predetermined number of drops 62 and a single heddle 63, as shown in FIG. 1. If the leading thread end **43*a* is fed from the thread feed apparatus 41 to the upstream thread drawing-in nozzle 61*a* adjacent to the thread feed apparatus 41, then the thread end 43*a* is transferred to the downstream side along the axis X—X and passed through the drops 62 and heddle 63, as shown in FIG. 3. After the drawing-in operation has been completed, the thread drawing-in nozzles 61 of the closing type are each opened, and the thread 43 are then removed from the thread drawing-in apparatus 44 by the thread removing hooks 64 and 65, together with the drops 62 and heddle 63. When this occurs, the upstream side of the thread 43 has already been cut by the cutter 56 of the thread feed apparatus 41, as shown in FIG. 6, and the second suction nozzle 46 is in the open position wherein the thread 43 is released. The upstream side of the thread 43 is then removed from the thread feed apparatus 41 by the thread removing hooks 54 and 55 of the thread feed apparatus 41. Further, as shown in FIG. 7, the guide slits 63*a* and 63*b* formed in the upper and lower ends of the heddle 63 is inserted onto a pair of upper and lower horizontal heddle supporting bars 66*a* and 66*b*, respectively, and the heddle 63 with the thread 43 passed therethrough is supported by the heddle supporting bars 66*a* and 66*b*. Although only one drop 62, one heddle 63 and thread 43 are shown in FIG. 7 for convenience, a large number of pairs of the heddle supporting bars 66*a* and 66*b* are provided in the horizontal direction so that the heddles through which the threads have been passed in succession by the thread drawing-in apparatus 44 depending on the pattern to be produced can be selectively inserted onto a large number of pairs of the heddle supporting bars 66*a* and 66*b*. In FIG. 1, reference numeral 67 indicates a suction nozzle provided in the downstream side of the thread drawing-in apparatus 44 for drawing the leading thread end 43*a*, and reference numerals 68, 69 and 70, 71** are leasing threads provided to facilitate the separation of the threads removed together with the heddles, in the next stage.

In FIG. 7, there is shown the tieing-in machine 81 that has already been mentioned in connection with the second draw rod 53. The tieing-in machine 81 is a well known apparatus for tieing in the ends of threads and provided with a tieing-in head 82, a pair of clamps 83 and 84, a tieing-in frame 85 for supporting the head 82 and clamps 83 and 84, and a drum 86. The thread ends **43*b* of the cut sides of the threads 43 passed through the heddles 63 supported by the above described heddle supporting bars 66*a* and 66*b* are inserted through the upper portions of the clamps 83 and 84 and clamped. The thread ends 88*a* of warp threads 88 wound on a warp beam 87 are inserted through the lower portions of the clamps 83 and 84 and likewise clamped. As shown by the imaginary lines in FIG. 7, each thread end 43*b* and thread end 88*a* are joined together by the tieing-in head 82 which is moving above the frame 85 in the lateral direction substantially perpendicular to the threads 43 and 88. The unnecessary portion extending from the joined part is then cut off. The drum 86 is provided with peripherally mounted nappy brushes in order to apply tension on the thread ends 43*b* and 88*b* and thus facilitate the tieing-in operation of the tieing-in head 82. As shown in FIG. 6, the thread end 43*b* of the thread 43 is formed so as to have a length of the second predetermined dimension $l_2$ that is cut by the cutter 56. Therefore, the length of the thread end 43*b* can be adjusted depending on various types of tieing-in machines, by suitably setting the predetermined length $L_2$ to which the second draw rod 53** is lowered from the axis X—X.

The operation of the thread feed apparatus will hereinafter be described, and the operation of the thread feed method according to the present invention will also be described.

In FIG. 1, the thread 43 wound on the bobbin 42 is inserted from its leading thread end **43*a* through the thread guides 48 and 49 and drawn out to the first thread chuck 47 by hand. At this stage, the thread feed apparatus 41 is not started, and therefore the second thread chuck 51, first thread chuck 47, cutter 56 and third thread chuck 52 are all in open position wherein the thread 43 is removed. The first and second draw rods 50 and 53 are also in standby position. It is noted that a continuous operation is possible if the thread end of the bobbin 42 is joined with the thread end of a new bobbin. If the thread feed apparatus 41 is started, the thread 43 is then gripped and fixed by the first thread chuck 47. As shown in FIG. 2, the first draw rod 50 then moves in the down direction perpendicular to the axis X—X and is lowered by the predetermined distance $L_1$ measured from the axis X—X. As the first draw rod 50 is lowered, the thread 43 is guided and drawn into an elongated U-shape by the guide roller 50*b* of the first draw rod 50. The length of the drawn thread 43 from the first thread chuck 47 to the end face 49*a* of the thread guide 49 along the U-shaped portion becomes the first predetermined dimension 11. Thereafter, as shown in FIG. 3, the thread 43 is gripped at its upstream side by the second thread chuck 51 and at the same time released at the leading thread end 43*a* from the first thread chuck 47. After the thread 43 has been gripped by the second thread chuck 51 and released from the first thread chuck 47, the U-shaped dangling portion shown in FIG. 2 is transferred along the axis X—X by the injection effect of the first and second suction nozzles 45 and 46 to which the compress air has been supplied, and then fed to the thread drawing-in apparatus 44, as shown in FIG. 3. At the same time, the thread 43 fed to the thread drawing-in apparatus 44 is likewise transferred along the axis X—X by the thread drawing-in nozzles 62 of the thread drawing-in apparatus 44 that has been started, and passed through the drops 62 and heddle 63. As previously described, the first predetermined dimension $l_1$ of the U-shaped dangling portion of FIG. 2 is enough for the thread drawing-in length that the thread drawing-in apparatus 44** needs.

Figure 5:
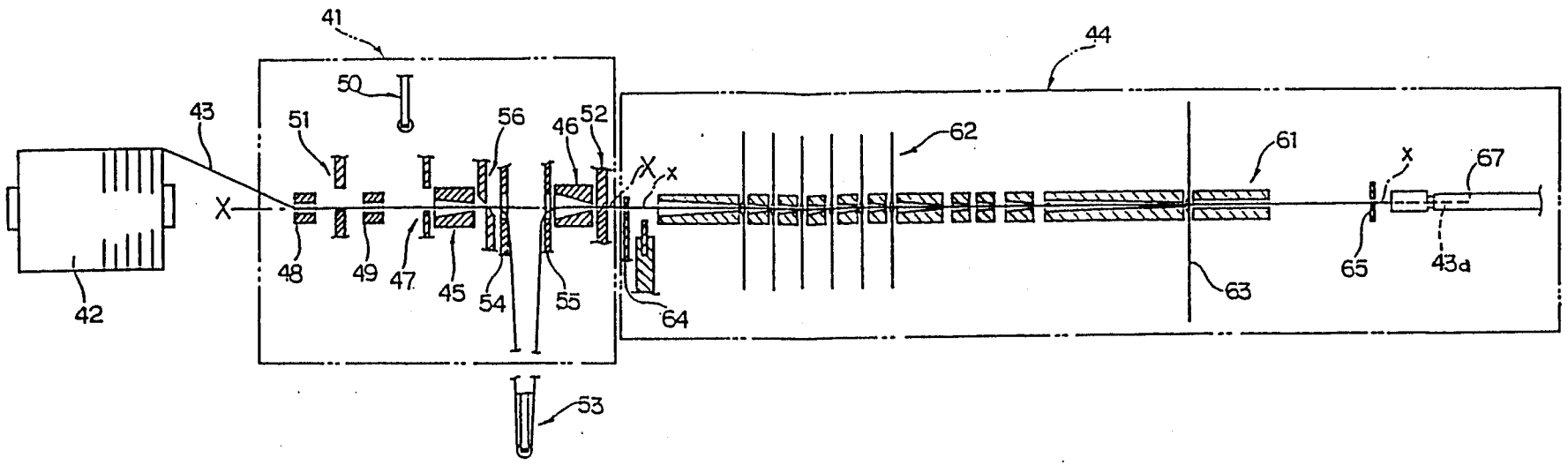
FIG. 5 is a view similar to FIG. 1 showing the cutter in closed position wherein the thread drawn down by the second draw rod is cut.

Thereafter, as shown in FIG. 4, the thread 43 that has already been fed to the thread drawing-in apparatus 44 is gripped by the third thread chuck 52 and released from the first and second thread chucks 47 and 51. In the same way as the first draw rod 50, the second draw rod 53 then moves in the down direction perpendicular to the axis X—X and is lowered by the predetermined distance $L_{12}$ measured from the axis X—X. As the second draw rod 53 is lowered, the thread 43 is guided and drawn into an elongated U-shape by the guide roller **53*b* of the second draw rod 53. The length of the drawn thread 43 between the thread removing hooks 54 and 55 along the U-shape becomes the second predetermined dimension $l_2$. After the drawing of the second draw rod 53, the thread 43 is cut at the position of the second predetermined dimension $l_2$ by the cutter 56, as shown in FIG. 5. As shown in FIG. 6, at the same time as the thread 43 is released from the third thread chuck 53, the second suction nozzle 46 of the thread feed apparatus 41 and the thread drawing-in nozzles 61 of the thread drawing-in apparatus 44 are opened, and then the cut thread 43 is removed by the thread removing hooks 54, 55 and 64, 65 from the thread feed apparatus 41 and thread drawing-in apparatus 44, together with the drops 62 and heddle 63. Thereafter, each mechanism of the thread feed apparatus 41 is returned back to the original state, and a new leading thread end 43*a* is gripped again by the first thread chuck 47, and the above described thread drawing-in operations are repeated. Therefore, the thread end 43*b* having a length of the second 25 predetermined dimension $l_2$ as shown in FIG. 6 is formed successively and removed. The above described operations are automatically performed by the thread feed apparatus 41, except that the thread end 43*a* is guided to the first thread chuck 41**.

In FIG. 7, the heddle 63 of the thread 43 that has been removed from the thread feed apparatus 41 and thread drawing-in apparatus 44 is inserted in sequence into the guide slits **63*a* and 63*b* of any one pair of the horizontal heddle supporting bars 66*a* and 66*b* and supported. Thereafter, the thread ends 43*b* of the threads 43 in which the heddles 63 have been supported by a large number of the heddle supporting bars 66*a* and 66*b* are clamped by the upper portions of the clamps 83 and 84 of the above described tieing-in machine 81, as shown in FIG. 7. In addition, the thread ends 88*a* of a large number of warp threads 88 are also clamped by the lower portions of the clamps 83 and 84. Each thread end 43*b* and thread end 88*a* are joined together at high speed by the tieing-in head 82 which is moving above the frame 85 in the lateral direction substantially perpendicular to the threads 43 and 88. The unnecessary portion extending from the joined part is then cut off. Consequently, the warp thread 88 has a guiding portion that has already been passed through the drops 62 and heddle 63, and the preparatory operations of the loom are completed. After the warp thread 88 has been removed from the tieing-in machine 81, it is transferred to a loom factory, together with the heddle supporting bars 66a and 66b**.

As previously indicated, in the present invention, the thread 43 is gripped or released by the thread first, second and third chucks 47, 51 and 52 in accordance with the timing of the thread drawing of the first and second draw rods 50 and 53, the timing of the thread forward movement of the first suction nozzle 45 and the timing of the thread cutting of the cutter 56. At the same time, the thread 43 from the bobbin 42 is drawn out by the first draw rod 50 by the first predetermined dimension $l_1$, that is, a length necessary for the drawing-in operation of the thread drawing-in apparatus 44, and then fed to the thread drawing-in apparatus 44. In addition, the thread is further drawn out by the second draw rod 53 by the second predetermined dimension $l_2$, that is, a length necessary for joining with the warp thread 88 of the warp beam 87, and then cut by the cutter 56. For these reasons, according to the number of the warp threads 88, the guiding portions for the warp threads 88 that have already been passed through the drops 62 and heddle 63 are formed in sequence, and joined with the warp threads 88 by the tieing-in machine 81. Accordingly, unlike the above described application and the conventional thread feed apparatus, it is not necessary that the warp threads 88 are drawn tautly in the drawing frame by hand. As a result, the above described drawbacks (i)–(v) can be eliminated as follows.

(i) Since there is no need for a drawing frame to draw threads tautly and for a complex feed apparatus to feed threads one by one with high speed and high accuracy from the drawing frame to the thread drawing-in apparatus, the cost of apparatus associated with the thread drawing-in apparatus can be reduced.

(ii) Since there is no need for an intricate operation to draw threads tautly so that tensions of the threads become uniform, the thread drawing-in cost and accordingly the production cost of final products (textile fabrics) can be reduced.

(iii) Since space for auxiliary apparatuses mentioned in (i), working space for the thread drawing operation and travel space for the drawing frame are not needed, the overall area of the textile factory can be reduced.

(iv) Since a thread that is most easily drawn in is drawn in and then joined with a warp thread so that the drawn thread becomes the guiding portion of the warp thread, the thread drawing-in rate can be enhanced independently of the nature and characteristics of the warp thread.

(v) Since the guiding portions of warp threads corresponding in number to the warp threads of wide fabric cloth can be formed in advance, the wide fabric cloth can be manufactured effectively.

While certain representative embodiments and details have been shown for the purpose of illustrating the invention, it will be apparent to those skilled in this art that various changes and modifications may be made therein without departing from the scope of the invention.

What we claim is:

1. A feed method of feeding a thread wound on a bobbin to a thread drawing-in apparatus through first and second suction nozzles, comprising the steps of:

advancing said thread from said bobbin to a first position between said bobbin and said first suction nozzle, along an axis;

gripping the advanced thread at said first position and then drawing said thread from said bobbin at said first position in a predetermined direction substantially perpendicular to said axis by a first predetermined length;

gripping the drawn thread at a second position between said bobbin and said first position and also releasing said drawn thread at said first position, and then passing said drawn thread through said first and second suction nozzles to feed it to said thread drawing-in apparatus;

gripping the fed thread at a third position between said second suction nozzle and said thread drawing-in apparatus and also releasing said thread at said first and second positions, and then drawing said thread from said bobbin at said third position in said predetermined direction by a second predetermined length; and cutting the thread that has been drawn by said second predetermined length, in such a manner that a length of the thread from said third position to the cut end of the thread becomes said predetermined second length.

2. A feed method as set forth in claim 1, wherein said thread is drawn by said first predetermined length by forming a generally U-shaped dangling portion in said thread.

3. A feed method as set forth in claim 1, wherein said thread is drawn by said second predetermined length by forming a generally U-shaped dangling portion in said thread.

4. A feed apparatus for feeding a thread wound on a bobbin to a thread drawing-in apparatus along an axis, comprising:

a first suction nozzle disposed downstream of said bobbin and formed with a passageway through which said thread is passed;

a second suction nozzle disposed downstream of said first suction nozzle and formed with a passageway through which said thread is passed;

first gripping means disposed between said bobbin and said first suction nozzle and for gripping and releasing the thread drawn from said bobbin;

first drawing means provided between said bobbin and said first gripping means and movable in a predetermined direction substantially perpendicular to said axis, the thread being gripped by said first gripping means and then being drawn from said bobbin in said predetermined direction by a first predetermined length by said first drawing means;

second gripping means disposed between said bobbin and said first drawing means and for gripping and releasing the thread that has been drawn by said first drawing means;

third gripping means disposed between said second suction nozzle and said thread drawing-in apparatus and for gripping and releasing the thread that has been fed through said first and second suction nozzles to said thread drawing-in apparatus;

second drawing means provided between said first and second suction nozzles and movable in said predetermined direction, the thread fed to said thread drawing-in apparatus being gripped by said third gripping means and being also released from said first and second gripping means, and then being drawn from said bobbin in said predetermined direction by a second predetermined length by said second drawing means; and cutting means disposed between said first suction nozzle and said second drawing means and for cutting the thread drawn by said second drawing means in such a manner that a length of the thread from said third gripping means to the cut end of the thread becomes said predetermined second length.

5. A feed apparatus as set forth in claim 4, which further comprises thread removing means disposed between said cutting means and said second suction nozzle for removing said thread from said feed apparatus after it has been cut by said cutting means.

* * * * *